US008025418B2

(12) United States Patent
Zick

(10) Patent No.: US 8,025,418 B2
(45) Date of Patent: Sep. 27, 2011

(54) ELECTRICAL COMPONENT, SUCH AS A LIGHTING UNIT AND BATTERY CHARGER ASSEMBLY

(75) Inventor: Jonathan Zick, Waukesha, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 12/618,816

(22) Filed: Nov. 16, 2009

(65) Prior Publication Data

US 2010/0053943 A1 Mar. 4, 2010

Related U.S. Application Data

(63) Continuation of application No. 11/393,258, filed on Mar. 30, 2006, now Pat. No. 7,621,652.

(60) Provisional application No. 60/667,147, filed on Mar. 31, 2005.

(51) Int. Cl.
*F21V 19/04* (2006.01)
*F21L 4/00* (2006.01)

(52) U.S. Cl. ..... 362/20; 362/183; 362/285; 362/418

(58) Field of Classification Search ..... 362/285, 362/20, 183, 418, 276, 119, 249.07, 249.1, 362/288, 427, 430
See application file for complete search history.

(56) References Cited

U.S. PATENT DOCUMENTS

| | | | |
|---|---|---|---|
| 1,309,140 | A | 7/1919 | Knoblock |
| 3,787,678 | A | 1/1974 | Rainer |
| 3,792,314 | A | 2/1974 | Epstein et al. |
| 3,916,212 | A | 10/1975 | Prochazka et al. |
| 3,963,972 | A | 6/1976 | Todd |
| 4,000,403 | A | 12/1976 | Rice |
| 4,096,553 | A | 6/1978 | Roche |
| 4,156,891 | A | 5/1979 | Roche |
| 4,216,410 | A | 8/1980 | Feldstein |

(Continued)

FOREIGN PATENT DOCUMENTS

| | | |
|---|---|---|
| CA | 1340662 | 3/1989 |

(Continued)

OTHER PUBLICATIONS www.ledtronics.com/DS/GDL002-200/default.asp, Architectural and Landscape LED Floodlight, printed Jul. 22, 2004.

(Continued)

*Primary Examiner* — Bao Q Truong
(74) *Attorney, Agent, or Firm* — Michael Best & Friedrich LLP

(57) ABSTRACT

An apparatus includes a housing including an AC power input and a power tool battery port adapted to receive a power tool battery pack. A light body includes an illumination portion operable to emit light. The illumination portion is movably coupled to the housing such that the illumination portion is movable between an open position and a closed position in which the housing blocks the emitted light. A circuit includes a battery charger portion. The circuit is operable when AC power is available at the AC power input to direct AC power from the AC power input to the battery charger portion and from the battery charger portion to the power tool battery port to charge the power tool battery pack and to direct AC power to the illumination portion to emit the light. When AC power is not available, the circuit directs power from the power tool battery pack to the illumination portion to emit the light.

30 Claims, 8 Drawing Sheets

U.S. PATENT DOCUMENTS

| | | | | |
|---|---|---|---|---|
| 4,364,104 | A | 12/1982 | Holahan et al. | |
| 4,382,220 | A | 5/1983 | Marshall et al. | |
| 4,410,835 | A | 10/1983 | Zabroski | |
| 4,544,994 | A | 10/1985 | Steeves, Jr. | |
| 4,575,784 | A * | 3/1986 | Diau | 362/183 |
| 4,626,975 | A | 12/1986 | Miletich | |
| 4,686,424 | A | 8/1987 | Nuckolls et al. | |
| 4,691,157 | A | 9/1987 | McDermott | |
| 5,010,454 | A | 4/1991 | Hopper | |
| 5,012,394 | A | 4/1991 | Woodward | |
| 5,148,158 | A | 9/1992 | Shah | |
| 5,152,601 | A | 10/1992 | Ferng | |
| 5,169,225 | A | 12/1992 | Palm | |
| 5,169,226 | A * | 12/1992 | Friedman | 362/190 |
| 5,202,608 | A | 4/1993 | Johnson | |
| 5,203,621 | A | 4/1993 | Weinmeister et al. | |
| 5,465,196 | A | 11/1995 | Hasenberg et al. | |
| 5,471,114 | A | 11/1995 | Edwards et al. | |
| 5,587,645 | A | 12/1996 | Sciammarella et al. | |
| 5,592,066 | A | 1/1997 | Fan | |
| 5,646,486 | A | 7/1997 | Edwards et al. | |
| 5,685,637 | A | 11/1997 | Chapman et al. | |
| 5,746,495 | A | 5/1998 | Klamm | |
| 5,896,024 | A | 4/1999 | Bradus et al. | |
| 5,912,546 | A | 6/1999 | Sakou et al. | |
| 5,986,407 | A | 11/1999 | Chang | |
| 5,988,828 | A | 11/1999 | Prince et al. | |
| 5,988,833 | A | 11/1999 | Giese et al. | |
| 6,019,484 | A | 2/2000 | Seyler | |
| 6,034,505 | A | 3/2000 | Arthur et al. | |
| 6,045,232 | A * | 4/2000 | Buckmaster | 362/20 |
| 6,050,710 | A | 4/2000 | Grossman et al. | |
| 6,053,315 | A | 4/2000 | Yao | |
| 6,128,287 | A | 10/2000 | Freeburg et al. | |
| 6,154,008 | A | 11/2000 | Bradus et al. | |
| 6,176,593 | B1 | 1/2001 | Spitler et al. | |
| 6,215,276 | B1 | 4/2001 | Smith | |
| 6,222,343 | B1 | 4/2001 | Crisp et al. | |
| 6,260,985 | B1 | 7/2001 | Zeller | |
| 6,308,059 | B1 | 10/2001 | Domes | |
| 6,328,460 | B1 | 12/2001 | Grossman et al. | |
| 6,354,720 | B2 | 3/2002 | Grossman et al. | |
| 6,361,184 | B1 | 3/2002 | Hallgrimsson et al. | |
| 6,406,161 | B1 | 6/2002 | Lin et al. | |
| 6,431,726 | B1 | 8/2002 | Barton | |
| 6,456,035 | B1 | 9/2002 | Crisp et al. | |
| 6,502,949 | B1 | 1/2003 | Horiyama et al. | |
| 6,533,434 | B2 | 3/2003 | Yuen | |
| 6,575,590 | B1 | 6/2003 | Wadsworth | |
| 6,585,400 | B2 | 7/2003 | Leen | |
| 6,636,015 | B1 | 10/2003 | Levine et al. | |
| 6,897,785 | B2 | 5/2005 | Corbus | |
| 6,902,293 | B2 | 6/2005 | Tang | |
| 6,977,481 | B2 | 12/2005 | Smith | |
| 7,222,986 | B2 | 5/2007 | Mah | |
| 2001/0009515 | A1 | 7/2001 | Grossman et al. | |
| 2002/0021573 | A1 | 2/2002 | Zhang | |
| 2002/0158605 | A1 | 10/2002 | Sharrah et al. | |
| 2002/0181230 | A1 | 12/2002 | Yuen | |
| 2002/0191396 | A1 * | 12/2002 | Reiff et al. | 362/246 |
| 2003/0007355 | A1 | 1/2003 | Leen | |
| 2003/0081412 | A1 | 5/2003 | Sharrah | |
| 2003/0095403 | A1 | 5/2003 | Tang | |
| 2003/0161146 | A1 | 8/2003 | Sharrah et al. | |
| 2004/0179361 | A1 | 9/2004 | Hussaini et al. | |
| 2005/0156564 | A1 | 7/2005 | Krieger | |
| 2005/0157482 | A1 * | 7/2005 | Hsu | 362/20 |
| 2007/0024237 | A1 | 2/2007 | Cole, Jr. et al. | |

FOREIGN PATENT DOCUMENTS

| | | |
|---|---|---|
| CA | 1340662 | 7/1999 |
| CN | 2303150 Y | 1/1999 |
| DE | 20315308 | 3/2005 |
| EP | 1312855 | 5/2003 |
| EP | 1312855 A2 | 5/2003 |
| JP | 09154237 | 6/1997 |
| JP | 9154237 | 8/2009 |

OTHER PUBLICATIONS www.alpharubicon.com/prepinfo/LEDmamabear.htm, Energizer Folding LED light, printed Jul. 22, 2004.

www.ebay.com, Solar Car Emergency Light with Battery Charger, printed Jul. 22, 2004.

www.smarthome.com/9298.html, Flashlight, Radio and Charger Built inot One, printed Jul. 22, 2004.

www.ebay.com, 12V Porter Cable Battery Flashlight #869, printed Jul. 22, 2004.

http://shop.store.yahoo.com/toolsplus/d-adw908.html, 18 Volts Pivot Heavy Duty Flashlight, printed Jul. 22, 2004.

http://buy1.snapon.com/. . . , Spotlight, Rechargeable, Halogen, VERSA VOLT, printed Jun. 17, 2004.

www.bennetts.com/garage/heating?categoryId=232, a variety of lighting devices, printed Jul. 22, 2004.

www.wildday.co.uk/ProductDetails.aspx?productId=103, Coleman Foldable Pocket Light, printed Jul. 22, 2004.

www.prairiecraft.com/. . . , Ottlight Folding Table Light, printed Jul. 22, 2004.

www.save-on-crafts.com/dayligporlam.html, DayLight® Folding Task Lamp (U33050), printed Jul. 22, 2004.

www.onestopknifeshop.com/store/inova-x5mt-led-floodlight.html, Inova X5MT LED Floodlight, printed Jul. 22, 2004.

www.solardyne.com/larsiglig.html, Large Sign Lighting Kits, printed Jul. 22, 2004.

www.bargainoutfitters.com/cb/cb.asp?a=43920, Guide Gear® 20 LED Floodlight, printed Jul. 22, 2004.

www.ewennyangling.co.uk/headlamps.htm, a variety of headlamps, printed Jul. 22, 2004.

www.webbikeworld.com/r2/optronics/, LED Headlamp Flashlight, printed Jul. 22, 2004.

www.streamlight-flashlights.com/s1reledfl.html, SL-20XP™/LED/Halogen Flashlight, printed Jul. 22, 2004.

* cited by examiner

ELECTRICAL COMPONENT, SUCH AS A LIGHTING UNIT AND BATTERY CHARGER ASSEMBLY

RELATED APPLICATIONS

This patent application is a continuation of U.S. patent application Ser. No. 11/393,258 filed Mar. 30, 2006, now U.S. Pat. No. 7,621,652, which claims priority to prior-filed, U.S. Provisional Patent Application Ser. No. 60/667,147, filed Mar. 31, 2005, the entire contents of each are hereby fully incorporated by reference.

FIELD OF THE INVENTION

The present invention relates to electrical components, such as lighting units, and, more particularly, to a lighting unit, a battery charger, etc.

SUMMARY

Lighting units, such as, for example, floodlights, are used on many job sites. A floodlight generally provides a wide area of illumination for the job site. A floodlight is typically supported on a surface during use (though it may be carried by a user at times). In contrast, a flashlight generally provides a comparably small area of illumination and is typically carried by a user during use (though it may be supported on a surface at times).

Many cordless products (e.g., cordless power tools, equipment, etc.) are also used on the job site. A battery charger (e.g., a power tool battery charger) and a lighting unit, such as, for example, a floodlight, as a single unit provides multiple functions in a single product.

Power outages may occur on a job site, and the sudden loss of visibility, due to the loss of an AC-powered light may cause a hindrance to work or movement around the job site. A lighting unit, such as, for example, a floodlight, which is selectively powered by AC power or by DC power (e.g., a battery pack, a power tool battery pack, etc.) may provide alternate lighting when the AC power source is unavailable (e.g., due to a power outage, due to an interruption in the supply of AC power, in an emergency situation, etc.).

In some independent aspects and in some constructions, a lighting unit, such as, for example, a floodlight, may generally include a light portion and a battery charging circuit for charging a power tool battery pack. The battery charging circuit may provide a trickle charge or a normal charge mode for the power tool battery pack, and the battery pack to be charged may selectively power the lighting unit. The lighting unit may include a status indicator for indicating, for example, the status of one or more batteries to be charged by the charging circuit.

In some independent aspects and in some constructions, an electrical component, such as, for example, a battery charger, includes a light, such as, for example, a floodlight, for illuminating a work area.

In some independent aspects and in some constructions, a lighting unit, such as, for example, a floodlight, may generally include a light portion which may selectively be powered by an AC power source or by a DC power source. A power tool battery pack may provide the DC power source to selectively power the light portion. The DC power source may supply power to the light portion when the AC power source is unavailable (e.g., due to a power outage, due to an interruption in the supply of AC power, in an emergency situation, etc.).

In such constructions, the lighting unit may include a battery support portion on which a battery is supported. In some constructions, the battery may be releasably locked to the battery support portion.

In such constructions, the lighting unit may include a power selector to select the power mode to power the light portion. The power mode selector may include a controller which controls the selection of a power mode for the lighting unit between an AC power mode and a DC power mode. The controller may automatically select the DC power mode when the AC power source is unavailable (e.g., due to a power outage, due to an interruption in the supply of AC power, in an emergency situation, etc.). The controller may selectively control charging of one or more battery packs connected to a charging circuit.

In some constructions, the lighting unit may include a pass-through plug or outlet on a portion of the lighting unit (e.g., on the base housing, on the AC power cord, etc.).

In some constructions, the lighting unit may include a battery-powered flashlight providing the light portion which is selectively powered by the DC power source. The lighting unit may include a charging assembly for charging the battery in the battery-powered flashlight. The flashlight may be removable from the lighting unit.

In some independent aspects and in some constructions, a lighting unit, such as, for example, a floodlight, may generally include a light portion having a high-watt light source, which is powered by an AC power source, and a low-watt light source, which is powered by a DC power source. The high-watt light source may include a halogen light source. The low-watt light source may be powered by the DC power source when the AC power source is unavailable (e.g., due to a power outage, due to an interruption in the supply of AC power, in an emergency situation, etc.).

In some independent aspects and in some constructions, a lighting unit, such as, for example, a floodlight, may generally include a light portion including a LED light source, and the LED light source may be selectively powered by an AC power source or by a DC power source. The LED light source may be a relatively low-watt light source which may be powered by a DC power source (e.g., a power tool battery pack) for a relatively long time.

In some independent aspects and in some constructions, a lighting unit, such as, for example, a floodlight, may generally include a light portion including a light source and a light housing and a base portion including a base housing. The light housing may be movable (e.g., pivotable) relative to the base housing between a closed position, in which the light source is at least partially covered by the base housing, and an open position. The lighting unit may include a light source supported on a head which is pivotable relative to a housing (e.g., the light housing, the base housing, etc.). The head may be pivotable about a single axis or about multiple axes.

In such constructions, the lighting unit may include a position fixing arrangement, such as a detent arrangement, for releasably holding the light housing in a selected position relative to the base housing. The lighting unit may include a locking assembly for releasably holding the light housing in a selected position (e.g., in a closed position) relative to the base housing.

A handle may be provided to carry the lighting unit to, from and around a worksite. The handle may provide a protective structure to protect a portion of the lighting unit, such as, for example, the light portion, a battery charger portion, a battery, etc. The lighting unit may include a separate protective structure, such as a protective bar, for protecting a portion of the lighting unit.

In some independent aspects and in some constructions, a lighting unit, such as, for example, a floodlight, may be constructed to be a heavy-duty, durable lighting unit for use on a job site. The lighting unit may be constructed to withstand impacts which may occur on a job site. In some constructions, the lighting unit may include another electrical component such as, for example, an audio component. In some constructions, the lighting unit may include an internal power source, such as, for example, a generator, a supply battery, etc.

In some independent aspects and in some constructions, a lighting unit, such as, for example, a floodlight, may be selectively mounted or supported on various surfaces, such as, for example, supported on a horizontal work surface, hung from a substantially vertical wall or support, supported on a separate frame or stand, etc. The lighting unit may include a telescoping support assembly for adjusting the height of a light portion relative to a housing (e.g., a light housing, a base housing, a separate frame or stand, etc.).

In such constructions, the lighting unit may include connecting structure for releasably connecting the lighting unit to a support. Such connecting structure may be similar to a Clip-Lok™ system provided for power tools, accessories, etc.

In some independent aspects and in some constructions, a lighting unit, such as, for example, a floodlight, may include a storage compartment for storing tools, extra bulbs for the light portion, etc.

In one construction, the invention provides an apparatus that includes a housing including an AC power input and a power tool battery port adapted to receive a power tool battery pack. A light body includes an illumination portion operable to emit light. The illumination portion is movably coupled to the housing such that the illumination portion is movable between an open position and a closed position in which the housing blocks the emitted light. A circuit includes a battery charger portion. The circuit is operable when AC power is available at the AC power input to direct AC power from the AC power input to the battery charger portion and from the battery charger portion to the power tool battery port to charge the power tool battery pack and to direct AC power to the illumination portion to emit the light. When AC power is not available, the circuit directs power from the power tool battery pack to the illumination portion to emit the light.

In another construction, the invention provides an apparatus that includes a frame, a light body movably supported by the frame, and a power tool battery port coupled to the frame and configured to receive a power tool battery pack. The power tool battery pack is operable to deliver a flow of DC power. An illumination portion is operable to emit light. The illumination portion is coupled to the light body and is movable to a closed position wherein the illumination portion is substantially covered by at least one of the light body and the frame to block the emitted light. A circuit is coupled to the illumination portion and includes an AC input portion that selectively receives an AC power from an external AC power source. The circuit includes a battery charger portion and is operable to direct AC power, when available to the battery charger portion to charge the power tool battery pack and to direct AC power to the illumination portion to emit the light, and to direct the flow of DC power from the power tool battery pack to the illumination portion to emit light when the AC power is not available.

In yet another construction, the invention provides an apparatus that includes a base housing including at least one wall that defines a pocket, a light body movably supported by the base housing, and a power tool battery port coupled to the base housing and configured to receive a power tool battery pack. The power tool battery pack is operable to deliver a flow of DC power. An illumination portion is operable to emit light. The illumination portion is coupled to the light body and is movable to a closed position wherein the illumination portion is substantially disposed within the pocket to protect the illumination portion from impacts. A circuit is coupled to the illumination portion and includes an AC input portion that selectively receives an AC power from an external AC power source. The circuit includes a battery charger portion and is operable to direct AC power, when available to the battery charger portion to charge the power tool battery pack and to direct AC power to the illumination portion to emit the light, and to direct the flow of DC power from the power tool battery pack to the illumination portion to emit light when the AC power is not available.

One or more independent features and independent advantages are set forth in the following detailed description.

Figure 1:
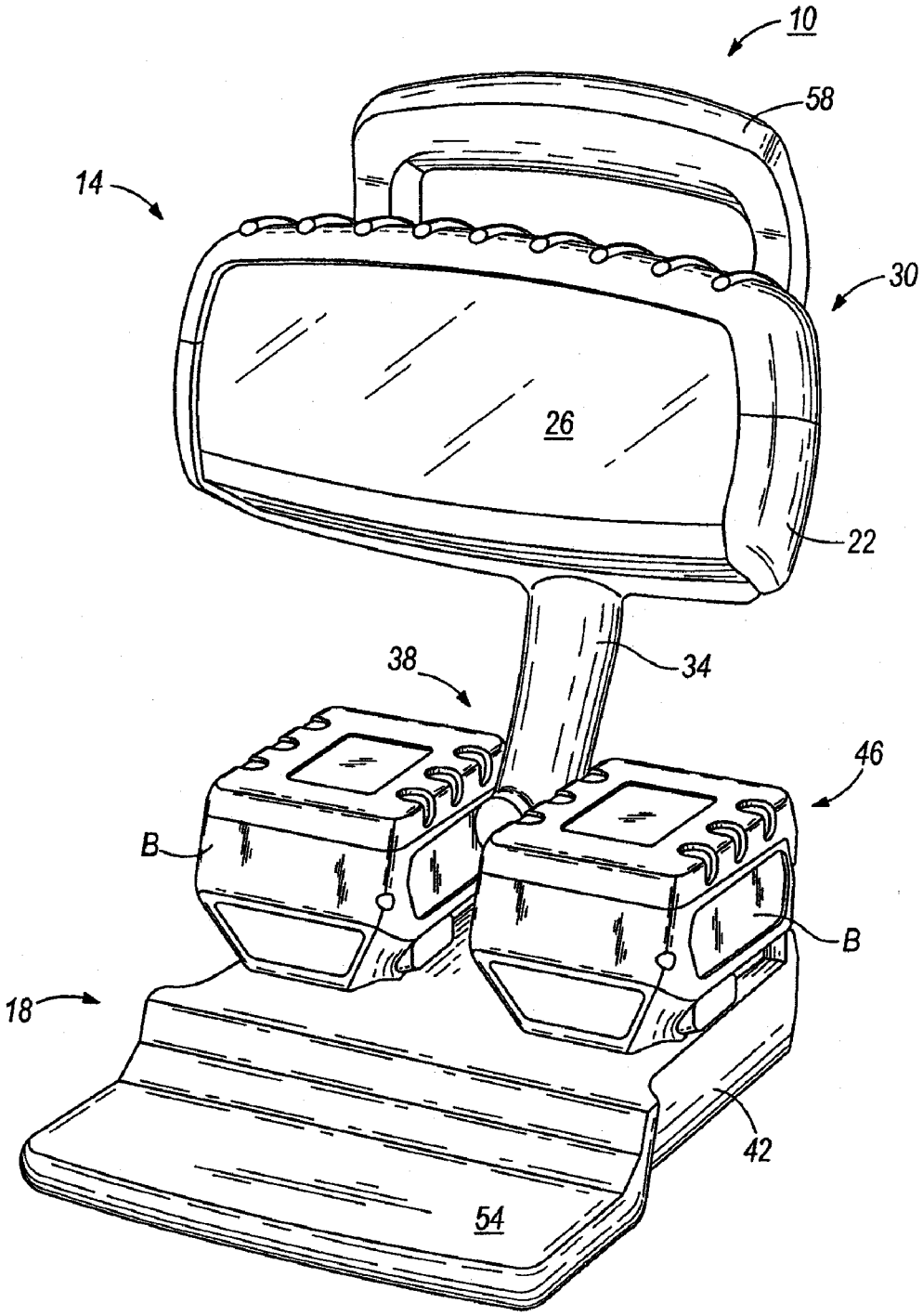
FIG. 1 is a perspective view of a lighting unit, illustrating a light portion in an open condition.

Before at least one embodiment of the invention is explained in detail, it is to be understood that the invention is not limited it its application to the details of the construction and the arrangements of the components set forth in the following description or illustrated in the drawings. The invention is capable of other embodiments and of being practices or carried out in various ways. In addition, it is understood that the phraseology and terminology used herein is for the purpose of description and should not be regarded as limiting.

The use of "including", "comprising", or "having" and variations thereof herein is meant to encompass the items listed thereafter and equivalents thereof as well as additional items. Unless limited otherwise, the terms "connected", "coupled" and variations thereof herein are used broadly to encompass direct and indirect connections and couplings. In addition, the terms "connected" and "coupled" and variations thereof are not restricted to physical or mechanical connections or couplings.

DETAILED DESCRIPTION

Figure 2:
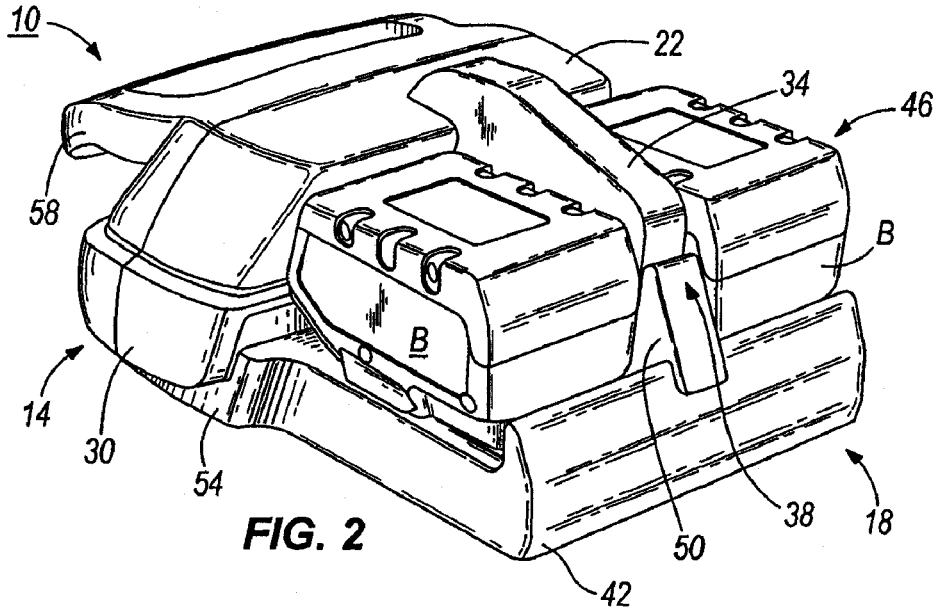
FIG. 2 is a perspective view of the lighting unit shown in FIG. 1, illustrating the light portion in a closed condition.
Figure 3:
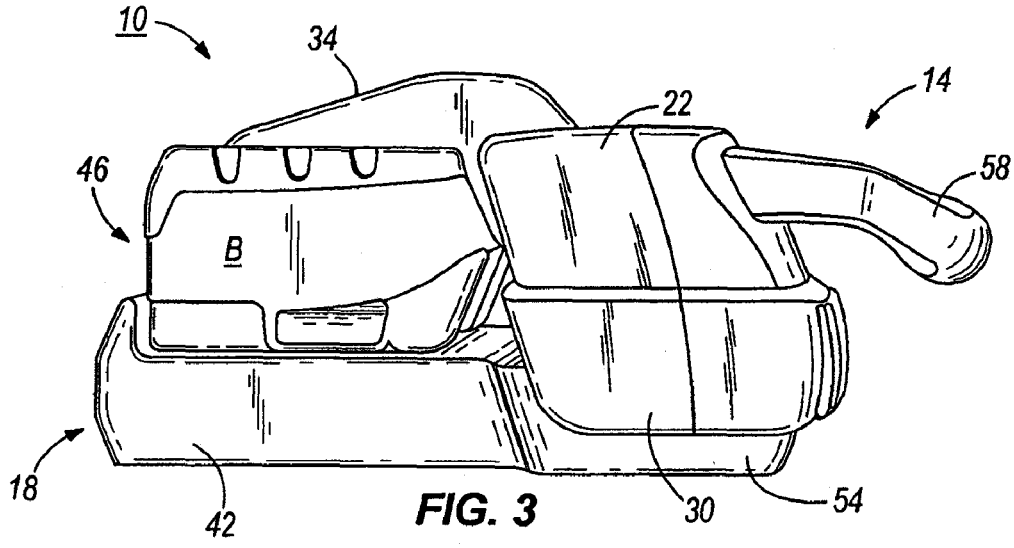
FIG. 3 is a side view of the lighting unit shown in FIG. 1, illustrating the light portion in the closed condition.

FIGS. 1-3 illustrate a lighting unit 10 embodying one or more independent aspects of the invention. In some independent aspects and in some constructions, the lighting unit 10 is a floodlight. In some independent aspects and in some constructions, the lighting unit 10 includes a battery charging circuit for charging a battery such as, for example, a power tool battery pack B. In some constructions and in some independent aspects, the lighting unit 10 is selectively powered by an AC power source (e.g., line power) or by a DC power source (e.g., the battery pack B).

In some constructions, the lighting unit 10 is constructed to be a heavy-duty, durable lighting unit 10 for use on a job site. The lighting unit 10 may be constructed to withstand impacts which may occur on a job site.

In the illustrated construction, the battery pack B is a slide-on power tool battery pack having a voltage of between 9.6V and 40V. A similar battery pack is illustrated and described in U.S. patent application Ser. Nos. 10/720,027, filed Nov. 20, 2003; Ser. No. 10/721,800, filed Nov. 24, 2003; and Ser. No. 10/719,680, filed Nov. 20, 2003; the entire contents of all of which are hereby incorporated by reference.

The lighting unit 10 generally includes a light portion 14 supported by a base portion 18. The light portion 14 includes a light housing 22 supporting a light assembly, illuminating portion or light source 26. In the illustrated construction, the light housing 22 is movably supported relative to the base portion 18. In the illustrated construction, the light housing 22 is pivotable relative to the base portion 18 between an open position (shown in FIG. 1) and a closed position (shown in FIGS. 2-3).

In some independent aspects and in some constructions, the light source 26 is selectively powered by one power source (e.g., an AC power source (line power)) or by another power source (e.g., a DC power source (a battery pack B)). The light source 26 may be powered by the DC power source when the AC power source is unavailable (e.g., due to a power outage, due to an interruption in the supply of AC power, in an emergency situation, etc.).

In some constructions, such as the illustrated construction, the light portion 26 includes a single type of light source which is selectively powered by both an AC power source and a DC power source. Such a light source 26 may be a LED light source or lighting element, which is a relatively low-watt light source. Such a low-watt light source may be powered for some time by a single charge of a battery pack B.

In other constructions, the light source 26 may include a high-watt light source or lighting element (e.g., a halogen light source) which is powered by a high-capacity power source (e.g., line power) and a separate low-watt light source or lighting element (e.g., a LED light source) which is powered by a lower-capacity power source (e.g., a battery pack B).

In some constructions, the low-watt light source and the DC power source may be provided by a battery-powered flashlight (not shown). The lighting unit 10 may include a charging assembly for charging the battery in the battery-powered flashlight. The flashlight may be powered when the AC power source is unavailable (e.g., due to a power outage, due to an interruption in the supply of AC power, in an emergency situation, etc.) and may be removable from the lighting unit 10.

In still other constructions, the light source 26 may include a single high-watt light source (e.g., a halogen light source) which may be powered by both an AC power source and a DC power source. In such constructions, the DC power source (e.g., a battery pack B) may only be able to supply power to the high-watt light source for a relatively short period of time before the battery pack B is discharged.

The light housing 22 includes a head portion 30, which supports the light source 26, and an arm portion 34, which is movably connected to the base portion 18. A pivot assembly 38 pivotably connects the arm portion 34 to the base portion 18. In the illustrated construction, the pivot assembly 38 provides relative movement between the arm portion 34 and the base portion 18 about a single generally horizontal axis. In other constructions (not shown), the pivot assembly 38 may provide relative movement between the arm portion 34 and the base portion 18 about multiple axes (e.g., a first generally horizontal axis, a second generally horizontal axis and/or a generally vertical axis, etc.).

In the illustrated construction, the head portion 30 is fixed to and movable with the arm portion 34. In other constructions (shown in FIG. 4*a* ), the head portion 30 may be movable (e.g., pivotable) relative to the arm portion 34 to further adjust the orientation of the light source 26 relative to the base portion 18. In such constructions, the head portion 30 may be pivotable relative to the arm portion 34 about a single axis (e.g., horizontal, vertical, etc.) or about multiple axes (e.g., horizontal and vertical, multiple horizontal, etc.).

Figure 5:
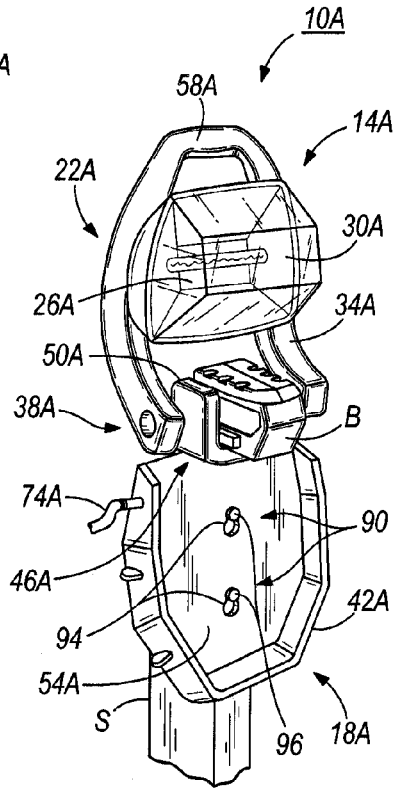
FIG. 5 is a perspective view of the lighting unit shown in FIG. 4, illustrating the light portion in a second open condition.
Figure 7:
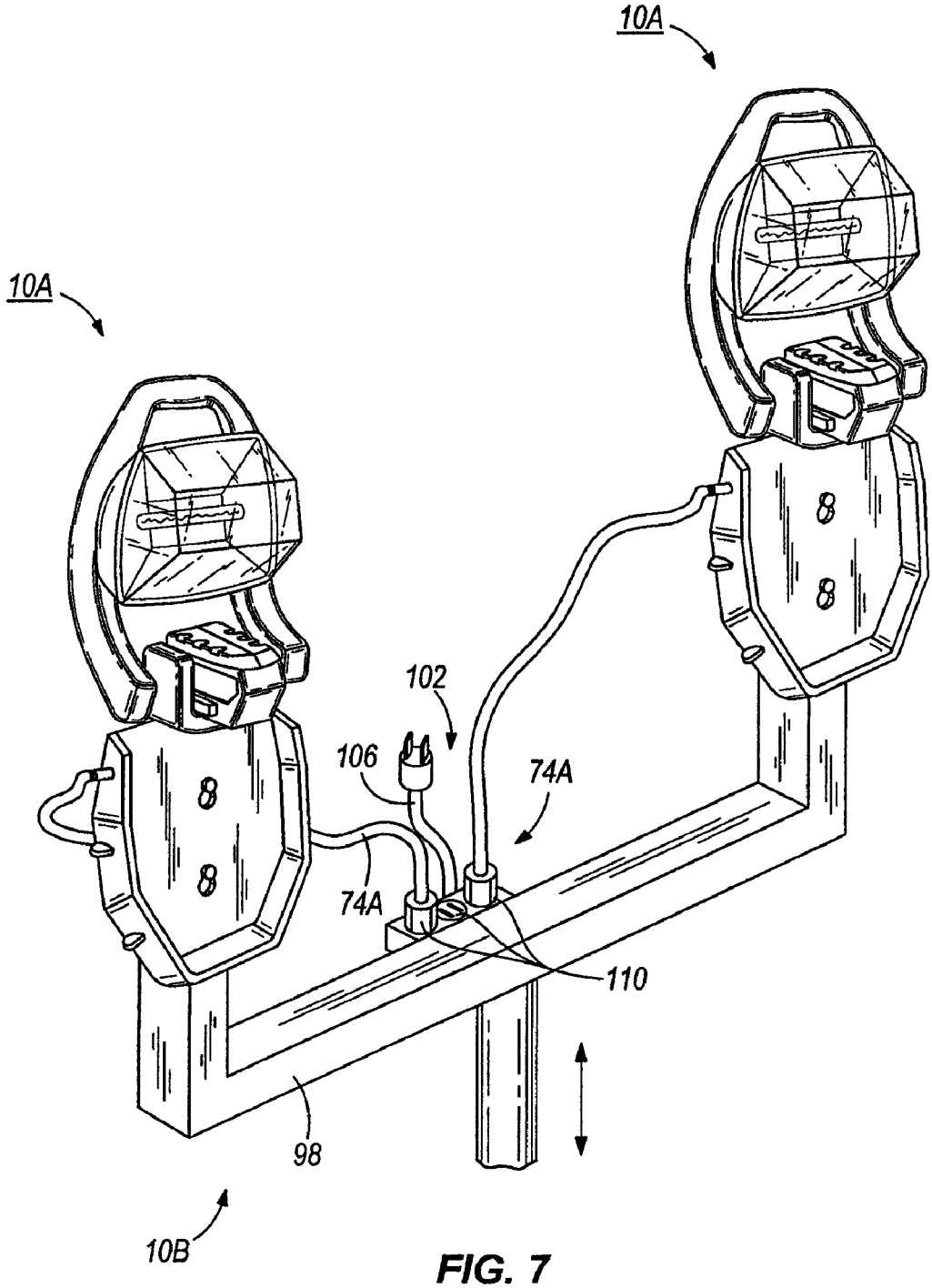
FIG. 7 is another alternate construction of a lighting unit, illustrating a lighting unit supported on a stand.

The base portion 18 includes a base housing 42 which, in the illustrated construction, is supported on a surface such as, for example, a work surface, a floor, etc. While, in the illustrated construction, the housing 42 is illustrated supported on a substantially horizontal surface, in other constructions, the housing 42 may be supported on a substantially vertical surface (e.g., hung from a wall or support S (as shown in FIG. 5)) or on a separate stand (as shown in FIG. 7) which is supported on a surface.

In the illustrated construction, at least the housing 42 is constructed to be durable and to withstand impacts which may occur on a job site. The housing 42 may be blow-molded and may include structure and materials to improve durability while maintaining an acceptable weight. The material and construction of the housing 42 may also provide heat resistance and/or heat dissipation for electrical components internal to the housing 42 (e.g., an electrical circuit, a battery charging circuit, etc.) and for other electrical components which may be positioned in proximity to the housing 42 (e.g., the light source 26 (when positioned in a closed position), the battery B, etc.).

The base portion 18 provides a sufficient base (e.g., area, weight, etc.) to support the lighting unit 10 in a stable condition when the light portion 14 is in an open position. In the illustrated construction, the base portion 18 includes a battery section 46 on which one or more batteries or battery packs B are supportable for use as a DC power source for the light source 26 and/or for charging.

A base arm 50 extends upwardly from the base portion 18. The arm portion 34 is pivotably connected to the base arm 50. In the illustrated construction, the base arm 50 is between adjacent battery packs B.

A section 54 extends forwardly of the battery support section 46. The section 54 provides a recessed area into which at least a portion of the light housing 22 and the light source 26 is positionable in the closed position (see FIGS. 2-3). The section 54 covers at least a portion of the light housing 22 and the light source 26 in the closed position. The section 54 may provide protection to at least a portion of the light source 26 in the closed position, for example, protecting the light source 30 from impacts during transport of the lighting unit 10 to, from and around a job site. The section 54 may be formed of impact resistant material and/or have an impact resistant structure (e.g., honeycomb cross-section). The section 54 may also be formed of heat resistant material and/or have a heat resistant structure (e.g., air flow passages) to resist and/or dissipate any heat generated by, for example, the light source 26.

A handle 58 is connected to the lighting unit 10 and may be used to move the lighting unit 10 to, from and around the job site. In the illustrated construction, the handle 58 is connected to the light housing 22 and may be used to move the light housing 22 relative to the base housing 22.

The handle 58 may also provide a protective structure for a portion of the lighting unit 10, such as, for example, the light assembly 30, a battery B connected to the lighting unit 10, the battery support section 46, etc. In other constructions (not shown) a separate protective structure such as, for example, a protective bar or wall may be provided. Such protective structure is described and illustrated in U.S. patent application Ser. No. 10/291,868, filed Nov. 8, 2002; Ser. No. 10/289,621, Nov. 7, 2002; and Ser. No. 10/840,703, filed May 6, 2004; the entire contents of all of which are hereby incorporated by reference.

A position fixing arrangement (not shown) may be provided between the light housing 22 and the base portion 18 to hold the light housing 22 is a selected position relative to the base portion 18. Such a position fixing arrangement may include detent arrangement (not shown) including a projection (not shown) on one of the light housing 22 and the base housing 42 which is engageable in a recess (not shown) on the other of the light housing 22 and the base housing 42 corresponding to a selected position of the light housing 22 relative to the base housing 42 to retain the light housing 22 in that selected position. A plurality of recesses (not shown) each of which correspond to a selected position of the light housing 22 relative to the base housing 42 (e.g., a closed position, a first open position, a second open position between the closed position and the first open position, etc.) may be provided, and the projection may be engaged in one of the recesses to retain the light housing 22 in the selected position relative to the base housing 42.

A biasing member (not shown) may be provided to bias the projection into an engaged position with a selected recess. The force of the biasing member may be overcome by a user applying force to a portion of the lighting unit 10 (e.g., to the light housing 22) to move the light housing 22 relative to the base housing 42 from a selected position.

In other constructions, an actuator (not shown) may be provided to move the projection out of engagement with a selected recess. Such an actuator may be a knob, a lever, etc. which is operable by a user to enable the user to move the projection out of engagement with the selected recess to then allow the user to move the light housing 22 relative to the base housing 42.

A locking arrangement (not shown) may be provided to lock (e.g., by positive engagement, by frictional engagement, by combination positive/frictional engagement, etc.) the light housing 22 in a position relative to the base housing 42, such as, for example, in a closed position, in an open position). The locking arrangement may include inter-engaging locking members (not shown but similar to the members of the detent arrangement) which are positively engageable to retain the light housing 22 in the selected position relative to the base housing 22. The locking arrangement may include one or more frictional or clamping locking members (not shown) which provide a frictional or clamping force to retain the light housing 22 in the selected position relative to the base housing 42. An actuator may be provided to disengage the locking member(s) to allow movement of the light housing 22 relative to the base housing 42 from the locked position.

In some constructions, the lighting unit 10 may include another electrical component (not shown) such as, for example, an audio component. In some constructions, the lighting unit 10 may include an internal power source (not shown), such as, for example, a generator, a supply battery, etc. In some constructions, the lighting unit 10 may include a storage compartment (not shown) for storing tools, extra bulbs for the light portion, etc.

Figure 8:
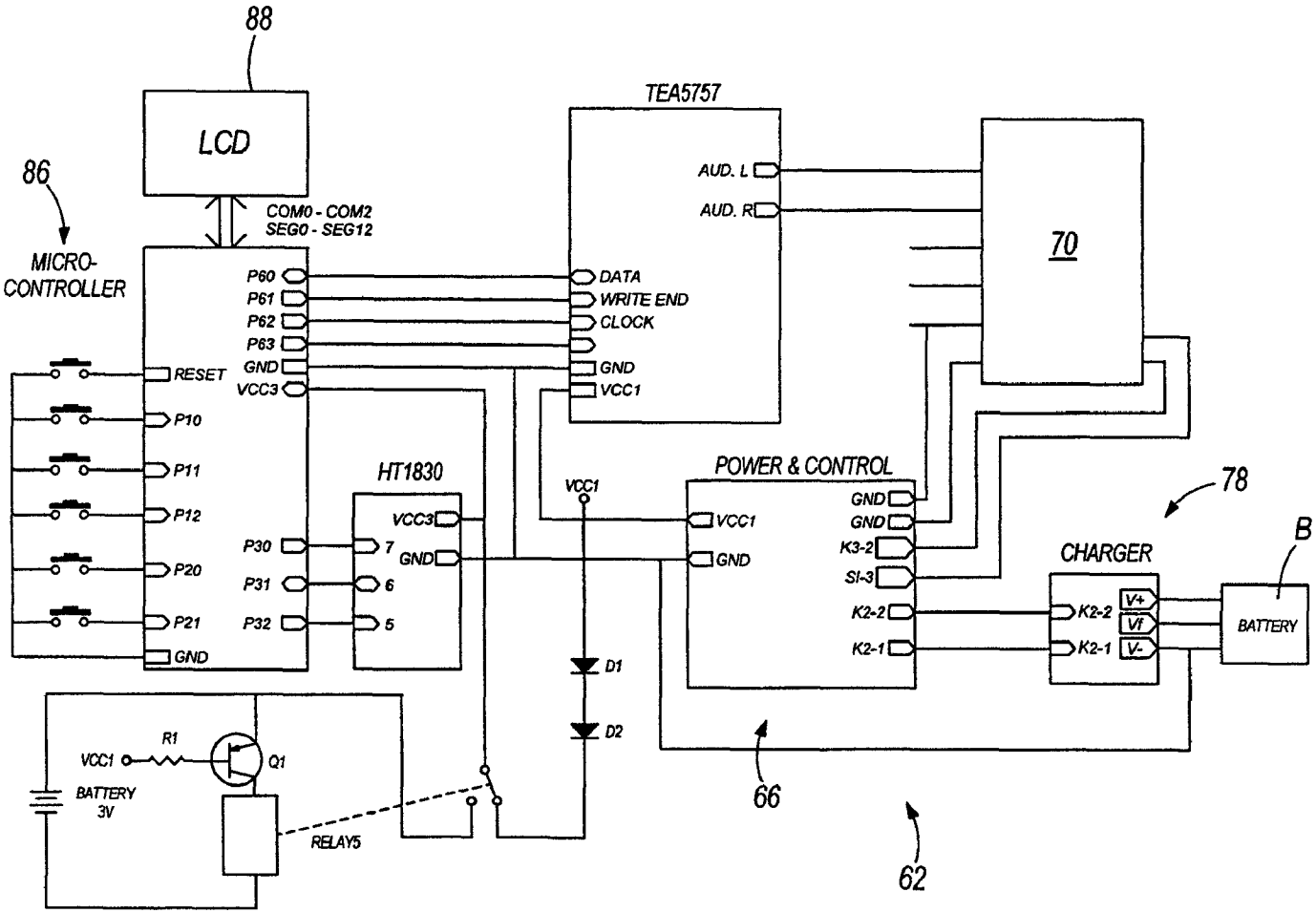
FIG. 8 is schematic diagram of an electrical circuit for a lighting unit.
Figure 9:
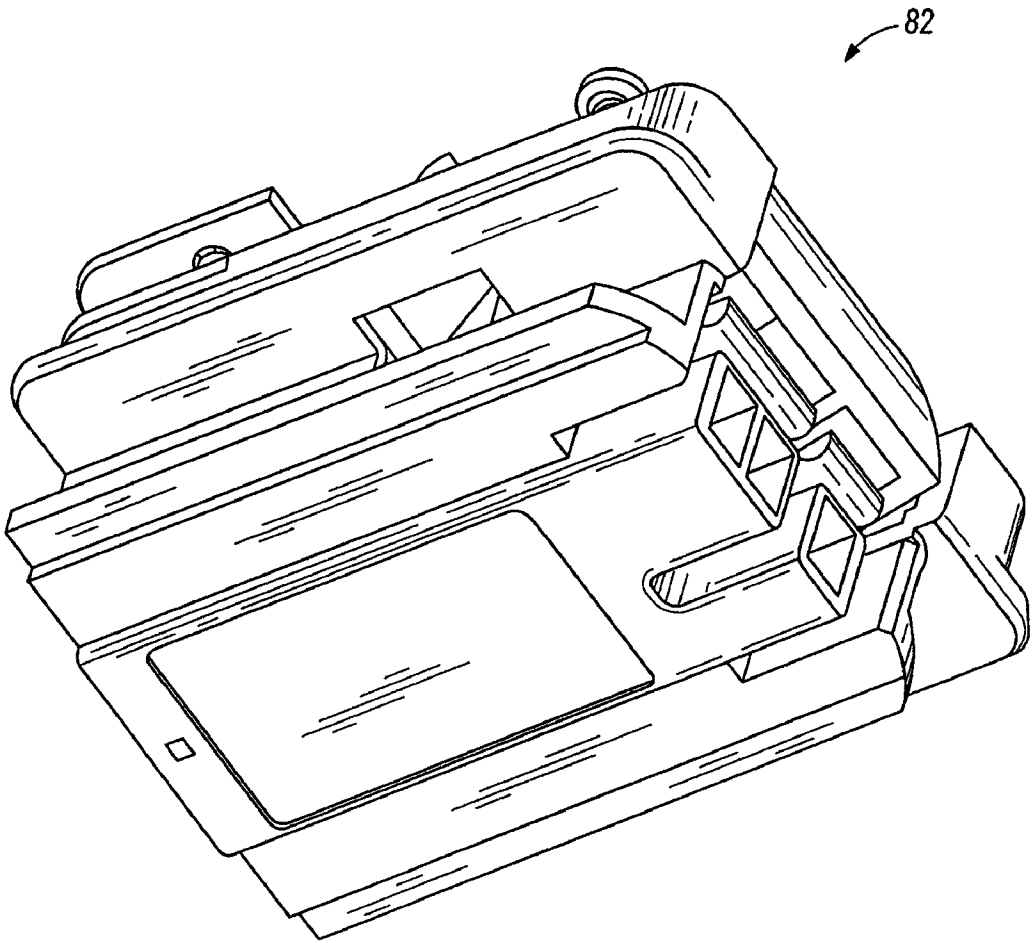
FIG. 9 is a perspective view of a battery support portion of a lighting unit.
Figure 10C:
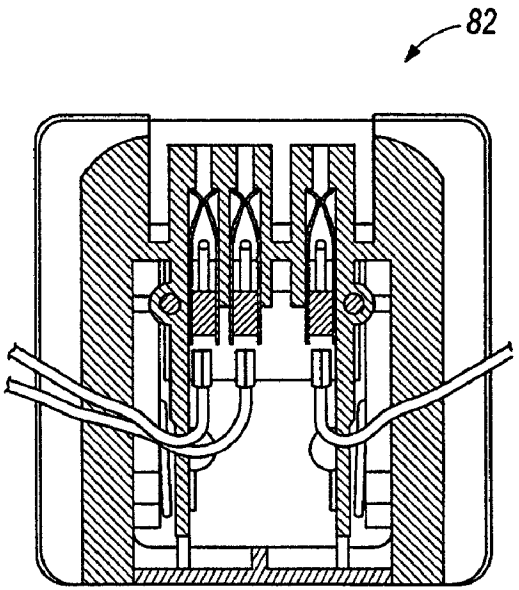
FIGS. 10A-10C are views of the battery support portion shown in FIG. 9.
Figure 10B:
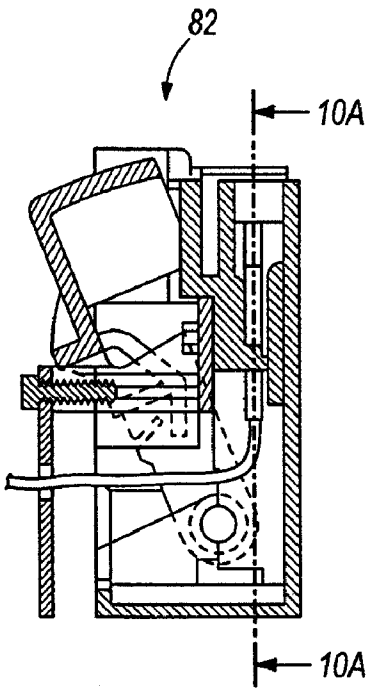
Figure 10A:
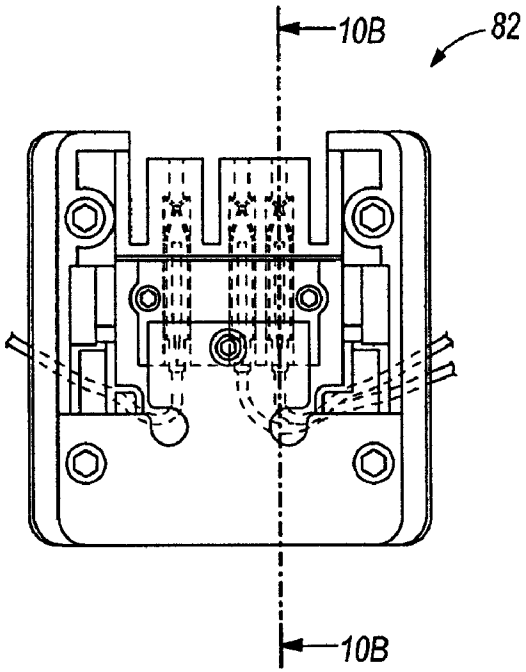

As shown in FIG. 8, the lighting unit 10 includes an electrical circuit 62. A portion 66 of the electrical circuit is supported by the base housing 42. An operational electrical circuit or light electrical circuit portion 70 is supported by the light housing 26. A power cord 74 is electrically connected and may provide power to the electrical circuit 66. The power cord 74 may connect the electrical circuit to an AC power source (e.g., line power). The lighting unit 10 may include a pass-through outlet (not shown but similar to outlet 110) on a portion of the lighting unit 10 (e.g., on the base housing 42, on the AC power cord 74, etc.).

In some independent aspects and in some constructions, the electrical circuit 62 includes a charging circuit 78 which is operable to charge one or more batteries, such as, for example, a battery pack B. The charging circuit may be any charging circuit which is suitable for charging the associated battery, such as a battery pack B. Suitable charging circuits are described and illustrated in U.S. Pat. No. 6,222,343, issued Apr. 24, 2001; U.S. Pat. No. 6,456,035, issued Sep. 24, 2002; U.S. Pat. No. 6,605,926, issued Aug. 12, 2003; and U.S. patent application Ser. No. 10/638,712, filed Aug. 11, 2003, the entire contents of all of which are hereby incorporated by reference. Other suitable charging circuits are described in U.S. patent application Ser. Nos. 10/291,868; 10/289,621; and 10/840,703; mentioned above.

As shown in FIGS. 9 and 10A-10C, a port 82 is provided to connect the battery pack B to the lighting unit 10. In the illustrated construction, two ports 82 are provided on the battery section 46 of the base housing 42. In the illustrated construction, each port 82 is operable to support an associated battery pack B on the lighting unit 10 and to electrically connect the associated battery pack B to the electrical circuit 62. In some constructions, such as the illustrated construction, each port 82 electrically connects the associated battery pack B to the charging circuit 78 such that each battery pack B is chargeable by the charging circuit 78. In some constructions, such as the illustrated construction, each port 82 electrically connects the associated battery pack B to the light electrical circuit portion 70 such that each battery pack B may selectively supply power to the light source 26.

Each battery pack B is removably connectable to the associated port 82. The battery pack B and the port 82 include complementary structure for mechanically connecting the battery pack B to the port 82 and for electrically connecting the battery pack B to the electrical circuit 66 of the lighting unit 10. Each port 82 may be similar to the port described and illustrated in U.S. patent application Ser. Nos. 10/291,868; 10/289,621; and 10/840,703, mentioned above.

In some constructions, the battery pack B may be removably locked to the port 82 so that the battery pack B will be retained on the port 82 absent some action by the user. For example, the battery pack B and the port 82 may include inter-engaging locking members (not shown) which retain the battery B on the port 82 and an actuator (not shown) which is engageable by the user to disengage the locking members. Such locking members and actuator may similar to the locking members and actuators provided by the battery pack B and a power tool.

As shown in FIG. 8, in some constructions, the electrical circuit 62 of the lighting unit 10 includes a controller 86. In some constructions, such as the illustrated construction, the controller 86 is operable to control charging of the battery pack(s) B. The controller 86 may communicate with the battery pack(s) B to determine the state of charge or other information from the battery pack B. The controller 86 may then operates to control the charging circuit 78 to charge the battery pack(s) B.

In some constructions, such as the illustrated construction, the controller 86 is operable control a power selection mode for the lighting unit 10. If the lighting unit 10 is connected to an AC power source (e.g., line power) and to a DC power source (e.g., a battery pack B), the controller 58 may select the appropriate power source for powering the lighting unit 10 and/or the light source 26.

For example, when the AC power source is unavailable (e.g., due to a power outage, due to an interruption in the supply of AC power, in an emergency situation, etc.), the controller 86 may operate to select the DC power mode so that power is supplied from the DC power source (e.g., the battery pack(s) B) to the electrical circuit 66 and/or to the light electrical circuit portion 70 and to the light source 26. If more than one battery pack B is provided, the controller 86 may determine from which battery pack B power is to be supplied and/or whether more than one battery pack B is selected to supply power.

An indicator 88 is provided for communicating the status of at least a portion of the lighting unit 10 to a user. In some constructions, such as the illustrated construction, the indicator 88 may indicate the charging status, the charging mode, etc. of the charging circuit 78. In some constructions, the indicator 88 may indicate to the user the state of charge of or other information from each battery pack B. In some constructions, the indicator 88 may indicate the power mode (e.g., "Power Off", AC power, DC power, etc.) of the lighting unit 10.

FIGS. 3-6 illustrate an alternative construction for a lighting unit 10A. Common elements are identified by the same reference number "A".

Figure 4:
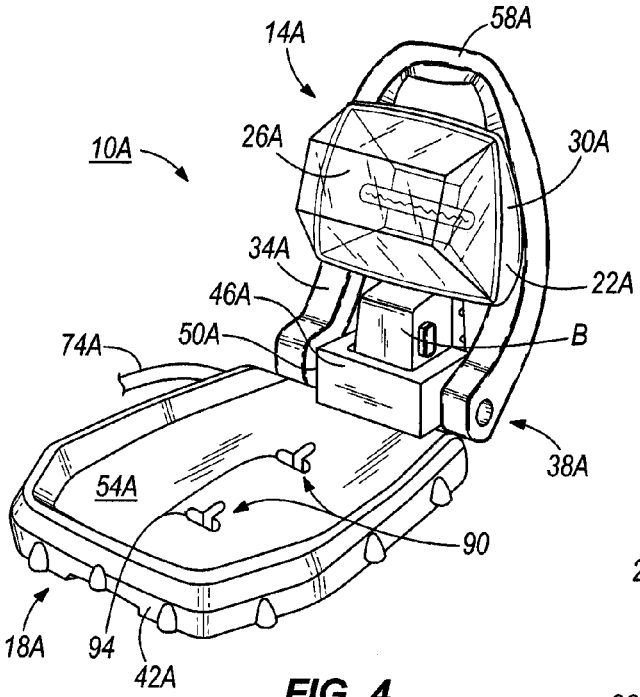
FIG. 4 is a perspective view of another construction of a lighting unit, illustrating the light portion in a first open condition.
Figure 4A:
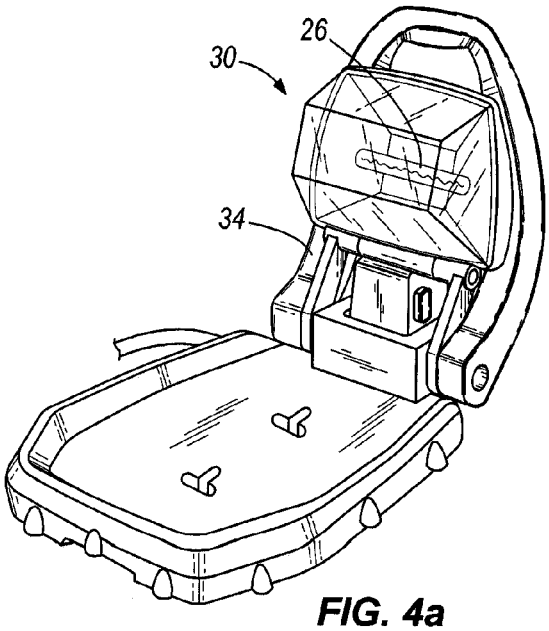
FIG. 4*a* is a perspective view of yet another construction of a lighting unit, illustrating a movable light portion in a first open condition.
Figure 6:
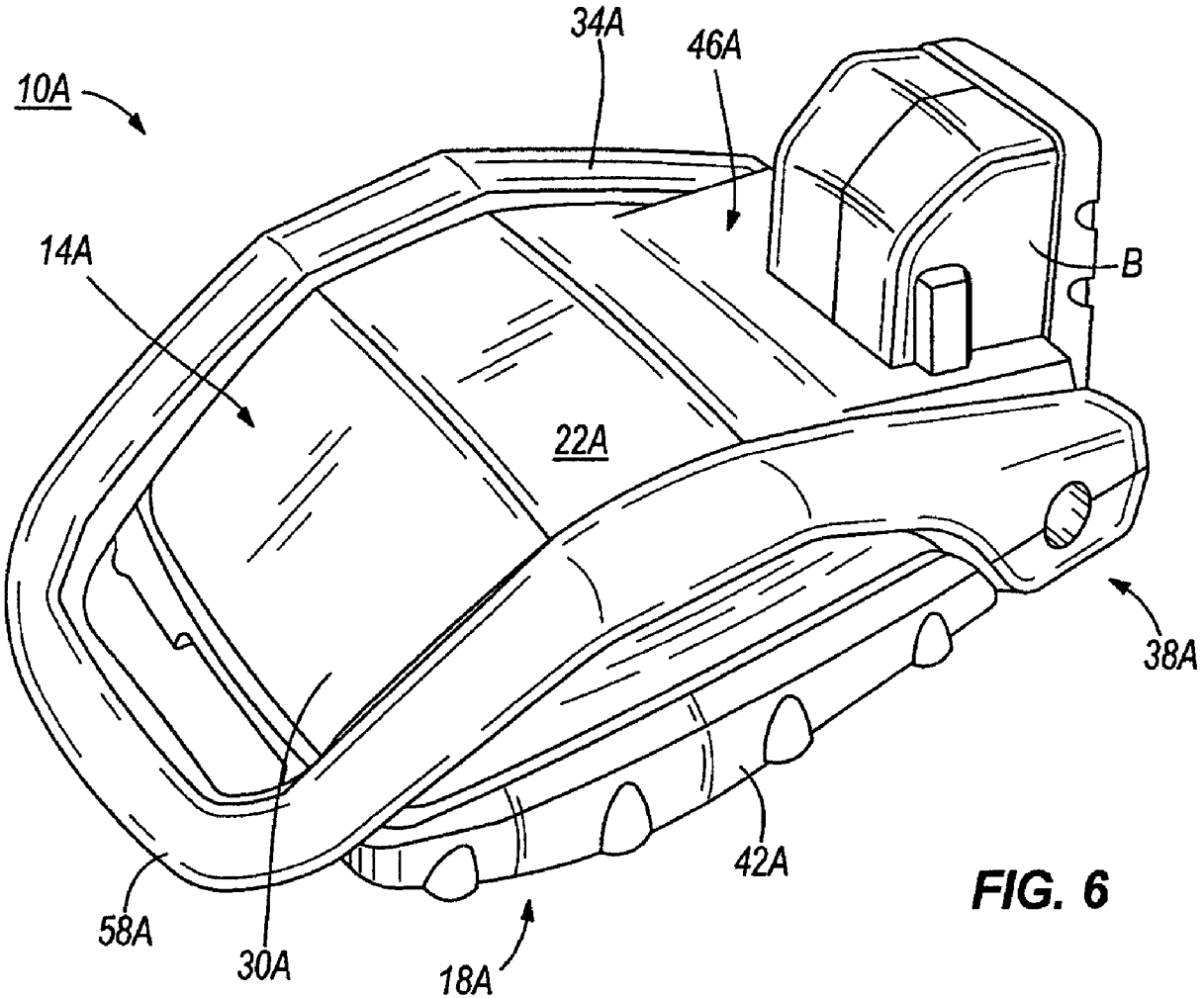
FIG. 6 is a perspective view of the lighting unit shown in FIG. 4, illustrating the light portion in a closed condition.

As shown in FIGS. 4-6, the light housing 22A may be movable between several positions relative to the base housing 42A. As shown in FIG. 4, the light housing 22A may be positioned in an intermediate open position in which the base housing 42A is supported on a substantially horizontal surface (e.g., a work surface, the floor, etc.). As shown in FIG. 5, the light housing 22A may be positioned in a fully-opened position in which the base housing 42A is supported by or connected to a substantially vertical surface (e.g., hung on a wall or support S). As shown in FIG. 6, the light housing 22A may be moved to a closed position relative to the base housing 42A.

As shown in FIGS. 4-6, in the illustrated construction, the handle 58A provides the arm portion 34A. The arm portion 34A may provide a protective structure for a portion of the lighting unit 10A, such as, for example, the light source 26A, the battery B, etc.

As shown in FIGS. 4-5, the lighting unit 10A includes connecting structure 90 for selectively connecting the lighting unit 10A to a support. In the illustrated construction, the connecting structure 90 includes one or more openings 94 defined by the base housing 42A which are engageable with projections 96 on a support. The connecting structure 90 may be similar to that described and illustrated in U.S. patent application Ser. No. 10/389,070, filed Mar. 14, 2002, the entire contents of which are hereby incorporated by reference.

FIG. 7 illustrates another alternative construction of a lighting unit 10B. Common elements are identified by the same reference number "B".

In the illustrated construction, the lighting unit 10B includes a pair of lighting units, such as lighting units 10A, which are connected to a frame 98. The frame 98 may be adjustable to adjust the height, position, orientation, etc. of the lighting units 10A.

The lighting unit 10B includes an electrical circuit 102. The electrical circuit 102 includes a power cord 106 for connecting the electrical circuit 102 to a power source (e.g., an AC power source, such as line power) and outlets 110 for connecting the power cord 74A of each lighting unit 10A to the power source. Additional pass-through outlets 110 may be provided to connect other electrical equipment (e.g., a radio, a battery charger, a corded power tool, etc.) to the power source.

Although the invention has been described in detail with reference to certain preferred embodiments, variations and modifications exist within the scope and spirit of one or more independent aspects of the invention as described.

What is claimed is:

1. An apparatus comprising:

a housing including an AC power input and a substantially external power tool battery port adapted to receive a power tool battery pack such that a substantial portion of the power tool battery pack is disposed outside of the housing;

a light body including an illumination portion operable to emit light, the illumination portion movably coupled to the housing such that the illumination portion is movable between an open position and a closed position in which the housing blocks the emitted light; and a circuit including a battery charger portion, the circuit operable when AC power is available at the AC power input to direct AC power from the AC power input to the battery charger portion and from the battery charger portion to the power tool battery port to charge the power tool battery pack and to direct AC power to the illumination portion to emit the light, and when AC power is not available to direct power from the power tool battery pack to the illumination portion to emit the light.

2. The apparatus of claim 1, wherein the light body is movable with respect to the housing and the illumination portion is movable with respect to the light body.

3. The apparatus of claim 1, wherein the illumination portion includes a single light source operable to emit light in response to a flow of either one of AC power and DC power.

4. The apparatus of claim 1, wherein the illumination portion includes a first light source that emits light in response to a flow of AC power and a second light source that emits light in response to a flow of DC power.

5. The apparatus of claim 1, wherein the power tool battery pack is not directly connected to the light body or the illumination portion such that the power tool battery pack must be connected to the housing to provide DC power to the illumination portion.

6. The apparatus of claim 1, wherein the housing at least partially protects the illumination portion when the illumination portion is in the closed position.

7. The apparatus of claim 1, wherein the illumination portion includes at least one LED.

8. The apparatus of claim 1, wherein the light body is only movable about a first axis that is fixed with respect to the housing.

9. The apparatus of claim 8, wherein the illumination portion is only movable about a second axis that is fixed with respect to the light body.

10. The apparatus of claim 9, wherein the first axis is parallel to the second axis.

11. An apparatus comprising:

a frame;

a light body movably supported by the frame;

a power tool battery port coupled to the frame and configured to receive a power tool battery pack such that a substantial portion of the power tool battery pack is outside of the frame, the power tool battery pack being operable to deliver a flow of DC power;

an illumination portion operable to emit light, the illumination portion coupled to the light body and movable to a closed position wherein the illumination portion is substantially covered by at least one of the light body and the frame to block the emitted light; and a circuit coupled to the illumination portion and including an AC input portion that selectively receives an AC power from an external AC power source, the circuit including a battery charger portion and being operable to direct AC power, when available to the battery charger portion to charge the power tool battery pack and to direct AC power to the illumination portion to emit the light, and to direct the flow of DC power from the power tool battery pack to the illumination portion to emit light when the AC power is not available.

12. The apparatus of claim 11, wherein the light body is movable with respect to the frame and the illumination portion is movable with respect to the light body.

13. The apparatus of claim 11, wherein the illumination portion includes a single light source operable to emit light in response to a flow of either one of AC power and DC power.

14. The apparatus of claim 11, wherein the illumination portion includes a first light source that emits light in response to a flow of AC power and a second light source that emits light in response to a flow of DC power.

15. The apparatus of claim 11, wherein the power tool battery pack is not directly connected to the light body or the illumination portion such that the power tool battery pack must be connected to the frame to provide DC power to the illumination portion.

16. The apparatus of claim 11, wherein the frame at least partially protects the illumination portion when the illumination portion is in the closed position.

17. The apparatus of claim 11, wherein the illumination portion includes at least one LED.

18. The apparatus of claim 11, wherein the illumination portion is only movable about a first axis that is fixed with respect to the light body.

19. The apparatus of claim 18, wherein the light body is only movable about a second axis that is fixed with respect to the frame.

20. The apparatus of claim 19, wherein the first axis is parallel to the second axis.

21. An apparatus comprising:

a base housing including at least one wall that defines a pocket;

a light body movably supported by the base housing;

a power tool battery port coupled to the base housing and configured to removably receive a power tool battery pack such that a substantial portion of the power tool battery pack is outside of the base housing, the power tool battery pack being operable to deliver a flow of DC power;

an illumination portion operable to emit light, the illumination portion coupled to the light body and movable to a closed position wherein the illumination portion is substantially disposed within the pocket to protect the illumination portion from impacts; and a circuit coupled to the illumination portion and including an AC input portion that selectively receives an AC power from an external AC power source, the circuit including a battery charger portion and being operable to direct AC power, when available to the battery charger portion to charge the power tool battery pack and to direct AC power to the illumination portion to emit the light, and to direct the flow of DC power from the power tool battery pack to the illumination portion to emit light when the AC power is not available.

22. The apparatus of claim 21, wherein the light body is movable with respect to the base housing and the illumination portion is movable with respect to the light body.

23. The apparatus of claim 21, wherein the illumination portion includes a single light source operable to emit light in response to a flow of either one of AC power and DC power.

24. The apparatus of claim 21, wherein the illumination portion includes a first light source that emits light in response to a flow of AC power and a second light source that emits light in response to a flow of DC power.

25. The apparatus of claim 21, wherein the power tool battery pack is not directly connected to the light body or the illumination portion such that the power tool battery pack must be connected to the base housing to provide DC power to the illumination portion.

26. The apparatus of claim 21, wherein the base housing at least partially covers the illumination portion when the illumination portion is in the closed position.

27. The apparatus of claim 21, wherein the illumination portion includes at least one LED.

28. The apparatus of claim 21, wherein the illumination portion is only movable about a first axis that is fixed with respect to the light body.

29. The apparatus of claim 28, wherein the light body is only movable about a second axis that is fixed with respect to the base housing.

30. The apparatus of claim 29, wherein the first axis is parallel to the second axis.

* * * * *